United States Patent [19]

Duimstra

[11] Patent Number: 4,906,962

[45] Date of Patent: Mar. 6, 1990

[54] FUSE WIRE SWITCH

[75] Inventor: Frederick A. Duimstra, Anaheim Hills, Calif.

[73] Assignee: Babcock, Inc., Orange, Calif.

[21] Appl. No.: 293,623

[22] Filed: Jan. 5, 1989

[51] Int. Cl.[4] ..... H01H 85/36; H01H 71/20

[52] U.S. Cl. ..... 337/239; 337/148

[58] Field of Search ..... 337/239, 238, 240, 218, 337/219, 217, 143, 148; 335/194

[56] References Cited

U.S. PATENT DOCUMENTS

| | | | |
|---|---|---|---|
| 2,934,625 | 4/1960 | Patrichi | 337/239 |
| 3,076,078 | 1/1963 | Murdock et al. | 337/239 |
| 3,517,366 | 6/1970 | Patrichi | 337/148 |
| 4,058,781 | 11/1977 | Schantz | 335/194 |

*Primary Examiner*—H. Broome

*Attorney, Agent, or Firm*—G. Donald Weber, Jr.

[57] ABSTRACT

A spring powered switching mechanism in which the energy required to complete switching is stored in a spring (or springs) which are constrained in a "cocked" or stressed condition by a fuse wire. The fuse wire has the characteristic of having a relative flat coefficient of resistivity over a large temperature range. The mechanism is operative to close (or open) electrical circuits permanently upon receipt of the appropriate electrical signal to the "fuse" or "bridge" wire which is caused to break as a result of the receipt of the electrical signal.

17 Claims, 2 Drawing Sheets

FUSE WIRE SWITCH

BACKGROUND

1. Field of the Invention.

A switching mechanism which selectively shorts (or opens) an electrical circuit, in general, and, more particularly, a spring-powered switching mechanism which is capable of one-shot operation under specified conditions over a long period of time.

2. Prior Art.

There are many switching mechanisms for electrical circuits which are well known in the prior art. Many of these switching mechanisms are electromechanical in nature, such as relays or the like. Also, many of these electromechanical switching mechanisms are "one-shot" devices such as latching relays or the like. That is, upon the application of a control signal, the "one-shot" switching mechanism is triggered into a prescribed position or condition. Typically, in the case of latching relays or the like, the position or condition of the device is altered (to the original condition) by the application of a different (or further) control signal.

In addition, there are other well known switching mechanisms for electrical circuits which are known in the art. For instance, many of these switching devices are of the semiconductor type. Likewise, there are other types of switching mechanisms which are capable of operating only on relatively small voltage, current and/or power signals. Consequently, these switching mechanisms have somewhat limited capabilities and applications.

Also, there are situations wherein a remote or hostile environment is involved. In this case, the switching mechanism must be capable of reliable operation over a long period of time, for example years, in the remote or hostile environment. In this type of arrangement, the switching mechanism which is disposed in the remote or hostile environment must be adapted for utilization in a particular application on a high reliability basis.

Examples of such hostile or remote environments are in outer space, underwater, and underground applications combined with extremes of temperatures and pressures or the like. In these cases, it is frequently required to use electrical circuits which are provided in substantial numbers and/or substantial redundancy. In this case, it is possible to use switching mechanisms to control the operation of the circuit by selectively shorting (or disconnecting) certain redundant circuitry in order to reduce power consumption, delete defective circuitry, replace defective circuitry with operable circuitry, or merely alter the configuration of the circuitry.

One such application is the circuitry used in devices which convert solar energy to electrical energy in space vehicles. In this case, a plurality of solar energy storage or conversion circuits and/or devices are connected in appropriate series and parallel circuit arrangements.

It is possible to detect and determine whether or not each individual electrical or solar energy storage or conversion circuit is operating properly. This can be accomplished through remote telemetry or the like. Upon an indication that one or more of the solar energy storage or conversion circuits (or cells) is defective, it is highly desirable to excise the defective cell from the overall circuit or panel in order to prevent unnecessary shorting, loading or the like.

A simple but effective method of effecting this excising of the defective cells is to provide suitable short or shunt circuits which selectively bypass these cells or merely disconnect the cells from the remainder of the cells.

Thus, it is highly desirable to have a switching mechanism which can effect this switch operation on a high reliability basis after a potentially long time period.

For example, a space vehicle or satellite may be in orbit for a number of years before a solar cell or panel becomes defective. Then, and only then, is it desirable (or necessary) to remove the defective unit from the circuit. Consequently, the switching mechanism must then operate reliably.

Moreover, it is also as important that the switching mechanism, after operation to effect the shorting (or disconnection) of the circuit, is capable of remaining in the new position indefinitely. Otherwise, if the switching mechanism should revert to the original condition, the defective unit comes back into play, thereby causing improper operation.

SUMMARY OF THE INSTANT INVENTION

A switching mechanism or switch assembly which is adapted to operate as a highly reliable, one-shot switch device. The switch includes at least two stationary terminals which are separated by a small gap. The small gap is, selectively, bridged by a spring driven, moving contact. The moving contact is, preferably, V-shaped to engage the two stationary terminals and, thus, bridge the gap therebetween. A spring mechanism is used to selectively move or drive the moving contact.

The spring mechanism is, typically, flexed and compressed in a particular condition or position and maintained in this flexed and compressed condition by means of a restraining wire which is attached to control terminals. When a selection signal is supplied to the two control terminals, the selection (or control) signal is of a magnitude sufficient to melt, vaporise (or otherwise break) the restraining wire. When the restraining wire is removed or broken, the flexed and compressed spring mechanism is released and both allows and forces the moving contact to move into electrical and mechanical contact with the first mentioned terminals noted above. The spring mechanism is designed to have sufficient force to maintain the moving contact in the new position, in electrical contact with the stationary terminals thereby to provide the intended shorting or disconnecting action.

The mechanism can be mounted within a housing which can be hermetically sealed. A suitable atmosphere can be provided in the form of an inert gas or the like, if desired.

DESCRIPTION OF THE PREFERRED EMBODIMENTS

Figure 1:
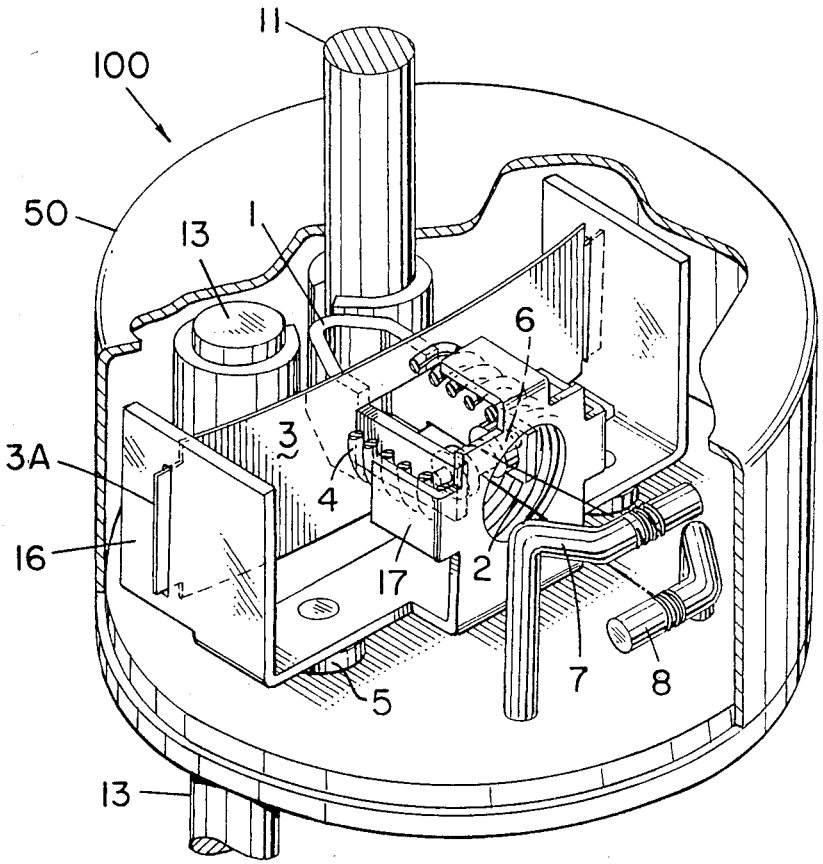
FIG. 1 is an isometric view of one embodiment of the switching mechanism of the instant invention.

Referring now to FIGS. 1 through 4 concurrently, there is shown a preferred embodiment of the "fuse wire switch" of the instant invention. In FIGS. 1 through 4, similar reference numerals refer to similar components. In particular, in FIG. 1 the normal, unactuated state of the switch is illustrated. Thus, the shorting bar 1 is in the restrained position and is held in a cocked or retracted state by the bridge wire 2.

The flat spring 3 and the compression spring 4 are also held in a deflected position by bridge wire 2. The support bracket 5 is permanently attached to the base 9 which can be a 304 L stainless steel, relay-type, header. The restraining bridge wire 2 is looped around a ceramic spool 6 which is free to rotate around a support wire 30 which mounts the spool 6 to the shorting bar 1. The two ends of the bridge wire 2 are attached to the bridge wire ground pin 7 and to the drive signal pin 8, respectively. The pin 8 is electrically isolated from the base 9 by the high temperature glass-ceramic bead 15. This bead 15 provides a cylindrical glass-to-metal seal as well as electrical isolation. The bridge wire ground pin 7 is electrically connected to the base 9.

The electrical circuit elements which are shown in the normally open state (in solid outline) are the electrically common contact 10 which is attached to the ground pin 11; the normally open contact 12 which is attached to the electrically isolated pin 13 and the gold plated silver shorting bar 1 previously described. The pins 11 and 13 are, in effect, the elements of this device which are to be selectively shorted by operation of the switching mechanism. The pins 11 and 13 are, typically, relatively large-diameter, copper-cored alloy 52 or RA333 rods, which are sized to carry current of up to 50 amps. Welded to the pins 11 and 13 are shaped contacts 10 and 12, respectively, which are made of a gold-plated, consul 995 silver alloy, for minimum contact resistance. These two stationary contacts are separated by a small gap. The pin 13 is electrically isolated from the stainless steel header base 9 by the high temperature, glass-ceramic bead 14. The ground pin 11 is electrically connected to the base 9.

In the embodiment shown, lid 50 includes a small hole that allows it to clear the pin 11. Typically, the cup shaped lid 50 is pressed in place and welded to the base 9 and around the pin 11 to form a hermetically sealed assembly. Welding, for example, laser welding, the metal cup-shaped cap 50 to the base 9 results in a closed structure, which can be filled with an optimum gas or gas mixture, e.g., an inert gas, to provide long storage life. The cap 50 is welded to the base 9 and to the pin 11 at the last step of fabrication, allowing complete assembly, adjustment, and testing.

The moving contact or shorting bar 1 is, in the preferred embodiment, a V-shaped, gold-plated, silver alloy element. The shorting bar 1 is fitted to a leaf-spring 3. The leaf spring 3 is, preferably, a flat spring which is supported between two support posts 16 such that the ends 3A of spring 3 can pivot freely. In the normal switch open condition the spring 3 is flexed, in such a direction that both the center of the spring and the moving contact element, shorting i.e. bar 1, are moved away from the stationary contacts 10 and 12 associated with the terminals 11 and 13, respectively. Also, compression or coil spring 4 is compressed between the flexed, flat spring 3 and the support bracket 5. The spring 3 is maintained in the flexed condition and the coil spring 4 is maintained in the compressed condition by a length of Nickel-Chromium-Aluminium restraining wire 2 which is looped through the compression spring 4, around the ceramic spool 6 at moving contact 1 and is attached at the ends thereof, to the contact terminals 7 and 8.

The selected alloy for the bridge wire 2 has a very low temperature coefficient of resistivity, which prevents thermal runaway and misfiring under low current conditions. The wire is sized to present 1 ohm to the switch drive circuit, which will allow the voltage to drop to 18 volts and still fire the switch with certainty and reliability. At 1 ampere, the wire is guaranteed not to fire, ensuring against inadvertent misfires due to leakage current or electromagnetic radiation.

When the battery monitoring circuitry (not shown) detects a defective battery cell, the associated switch driver circuit (not shown) applies an appropriate signal, e.g. 28 VDC, across terminals 7 and 8 of the switching device connected across the failed battery cell. In response to the applied signal, the restraining wire 2 heats up and melts or vaporizes. In one embodiment, this action occurs within 20 milliseconds. This action releases the restraint on the shorting bar 1 whereupon the springs 3 and 4 are both free to accelerate and drive the wedge-shaped shorting bar 1 to a new rest position (shown in dashed outline) and to maintain the shorting bar in engagement with the common contact 10 and the normally open contact 12. In particular, coil spring 4 is released from its compressed condition and forces flat spring 3 to drive the contact 1 forward. This condition completes an electrical circuit between pin 13 and ground pin 11 which circuit is capable of conducting high currents. Thus, the switch presents low resistance to the 50 ampere battery current. The geometry of the contact system ensures that the mating parts are driven into intimate contact over a large contact area, and are maintained in this contact position by the force of the drive springs. Also, the geometry provides a wiping action which enhances the electrical contact.

In addition, the restraining wire now presents an open circuit to the 28 VDC switch driver and ceases to draw current. Thus, the switch driver circuit does not have to turn off the switch drive signal.

Figure 2:
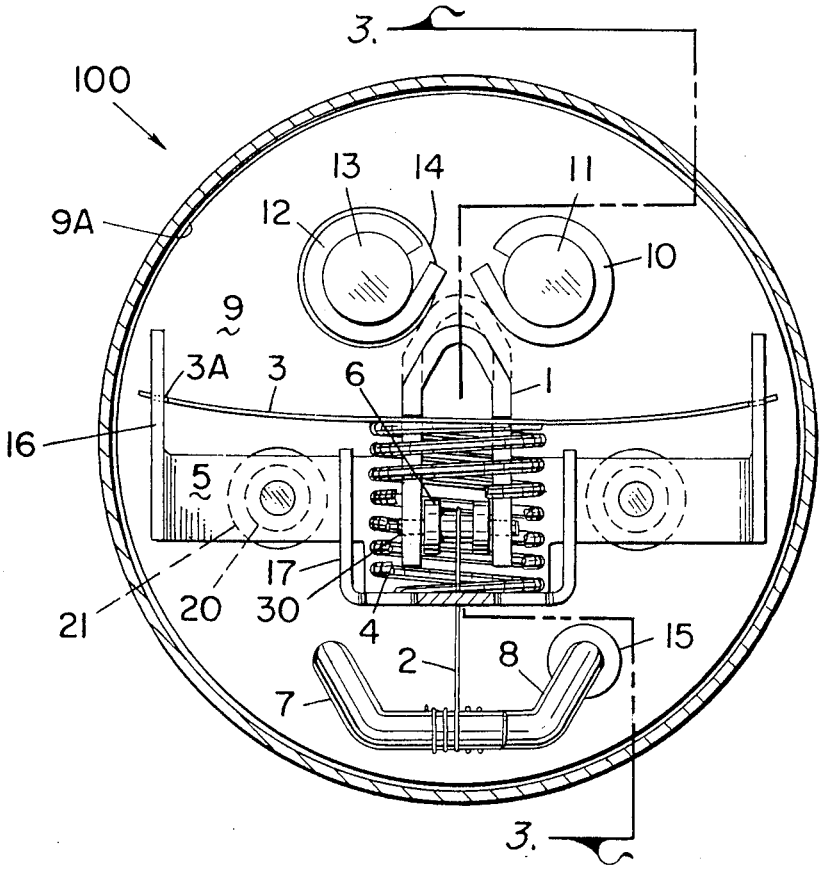
FIG. 2 is a top view of the apparatus of the instant invention showing a moving contact in both the restrained position (solid line) and the released position (dashed line).

FIG. 2 is a top plan view of the switch mechanism 100. The support bracket 5 is attached to base 9 in any suitable fashion, for example welding, as suggested by the representative welding posts 20. The welding posts 20 in this instance are electrically isolated from base 9 by suitable isolation means 21.

Figure 3:
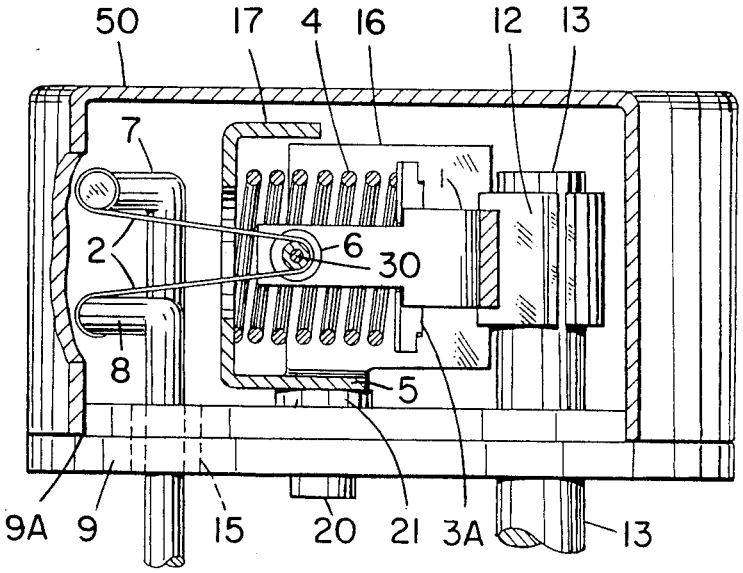
FIG. 3 is a side view of the switching mechanism in the restrained position.

The bridge wire 2, which can be an Evanohm wire, is wrapped around and attached (for example by welding) to the ground pin 7 and the pin 8 (see FIGS. 1 and 3). The bridge wire is looped around ceramic spool 6. The shorting bar 1 is shown in the retracted position (solid line) when the bridge wire 2 is intact.

Conversely, when the bridge wire 2 is broken as the result of a suitable control signal, the springs 3 and 4 are operative to force the shorting bar 1 forward (dashed outlined) into contact with the contact layers 10 and 12 to provide an electrical short therebetween. More particularly, the coil spring 4 assures that flat spring 3 will flex forward when the bridge wire is severed. Consequently, the unlikely chance of fatigue in flat spring 3 is avoided.

The mechanical configuration, choices of materials for the enclosure, insulators, fuse wire, power springs and contacts are all directed toward low contact resistance and long life span (in either the operated or unoperated state) when exposed to a large range of temperatures (−80° C.+600° C.).

The estimated life span of the switch apparatus is twenty-five years or more in either the operated or unoperated state. The embodiment illustrated is rated at 50 amperes continuous at 450° C. (no-fire). A preferred embodiment of the device weighs only 18.5 grams and does not require any power to maintain the switch in either the normally open or the closed state. The only power required for operation is a short duration pulse of, for example 18 volts, across the bridge wire 2.

Figure 4:
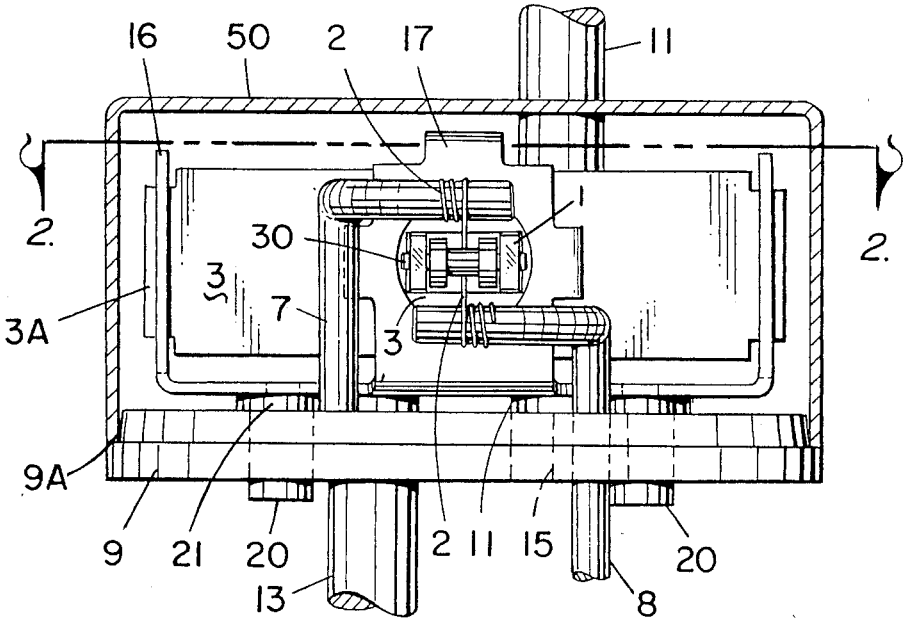
FIG. 4 is an end view of the switching mechanism in the restrained condition.

FIGS. 3 and 4 show some of the details of the mechanical structure of the switch mechanism. Of course, modifications to this structure are contemplated. For example, the support structure comprising posts 16 and bracket 5 for the flat spring 3 can be formed of a plurality of individual straps or stops disposed on the base 9 so as to receive the ends of the spring 3.

A variety of mounting arrangements for the unit can be offered. For example, a strap can be provided for welding to a battery cell container or nearby structure. One of the high-current terminals can be electrically tied to the case and the mounting strap, eliminating the need for one conductor strap. The terminals are suitable for resistance welding and or brazing to molybdenum, nickel, silver, copper or aluminum conductor straps. The preferred embodiment of the device will be 0.75 inch diameter ×0.5 inch high (exclusive of terminal pins).

Typically, one switching device is wired across each cell of a high temperature battery, and is intended to short out the cell if the cell is not performing satisfactorily. Each cell is monitored for condition by separate instrumentation, which also provides a 28 VDC signal to fire the appropriate switching device when required. Because sustained currents of less than 1 ampere have no effect on the bridge wire 2, the same circuit (not shown) that is used to ultimately fire the fuse wire can also be used to monitor the condition of the cell. This operation minimizes the number of thermal blanket penetratious, and, ultimately reduces heat losses and increases the blanket efficiency.

Because the switch is continuously exposed to the 350° to 450° C. temperature which is required for battery operation, the switch is, preferrably, fabricated of materials which are not affected by this heat. Since long exposure of organic construction materials to these temperatures will cause deposition of organic residue on the contact surfaces, in addition to structural deterioration, all use of organic materials is avoided. Even with entirely non-organic construction, the contact force should be as high as possible to assure a high contact area, low resistance path to the battery current.

Thus, there has been shown and described a switch which uses a unique combination of materials which are ideally selected, and a desireable mechanical arrangement in order to provide a compact package which will switch high current at very high temperatures, with long term reliability. The mechanical arrangement provides low stress on mechanical members which provides the long term, high temperature reliability. In addition, the mechanical arrangement for the switch configuration provides a relatively simplified assembly apparatus and, as well, enhances reliability as noted above.

While a preferred embodiment is shown and described, it is clear that modifications thereof may be conceived by those skilled in the art. However, any such modifications which fall within the purview of this description are intended to be included therein as well. That is, this description is intended to be illustrative only and is not intended to be limitative. Rather, the scope of the invention is limited only by the claims appended hereto.

I claim:

1. A spring powered switch mechanism comprising;
a first pair of electrically conductive terminals which are spaced apart from each other,
a second pair of electrically conductive terminals which are spaced apart from each other and from said first pair of electrically conductive terminals,
contact means adapted to be selectively moved into electrical contact with said first pair of electrically conductive terminals to effect electrical connection between said first pair of electrically conductive terminals via said contact means,
spring means adapted to selectively exert force on said contact means to move said contact means,
said spring means includes a leaf-spring which is selectively flexed to apply force to move said contact means,
said spring means further includes a coil spring which is flexed to apply a force to move said leaf-spring, and
a fusible link connected between said second pair of electrically conductive terminals,
said fusible link adapted to restrain said spring means and said contact means in a position separated from said first pair of electrically conductive termainals.

2. The mechanism recited on claim 1 wherein,
said fusible link is adapted to be broken by the application of a control signal thereto via said second pair of electrically conductive terminals.

3. The mechanism recited in claim 1 including,
supporting means for supporting said spring means.

4. The mechanism recited in claim 1 wherein,
said first pair of electrically conductive terminals include contact surfaces joined thereto.

5. The mechanism recited in claim 4 wherein,
said first pair of electrically conductive terminals are capable of carrying a current of up to 50 amperes.

6. The mechanism recited in claim 1 including,
housing means for enclosing the switch mechanism.

7. The mechanism recited in claim 6 including,
an inert gas included within said housing.

8. The mechanism recited in claim 2 wherein,
said contact means includes a V-shaped portion for selectively contacting said first pair of electrically conductive terminals.

9. The mechanism recited in claim 1 wherein,
said fusible link passes axially through said coil spring.

10. The mechanism recited in claim 1 including,
mounting means connected to said contact means,
said fusible link engages said mounting means to restrain said contact means.

11. The mechanism recited in claim 1 wherein,
said fusible link comprises a thin wire which can be selectively broken by application of an electrical signal to said second pair of electrically conductive terminals.

12. The mechansim in claim 3 wherein, said support means provides a pair of end posts which support the ends of said leaf-spring.

13. The mechanism recited in claim 10 wherein, said mounting means includes a support wire attached to said contact means and a ceramic spool mounted on said support wire.

14. The mechanism recited in claim 6 wherein, said housing means includes a support header as the base thereof.

15. The mechanism recited in claim 14 wherein, at least one terminal of each of said first and second pair of terminals is isolated from said header means by a glass-ceramic insulation bead.

16. The mechanism recited in claim 3 wherein, said support means is a unitary bracket for supporting both said leaf-spring and said coil spring.

17. The mechanism recited in claim 3 wherein, said coil spring is disposed between said support means and the middle of said leaf-spring in order to selectively apply force to said leaf-spring.

* * * * *